US006363740B1

(12) United States Patent
Hansen

(10) Patent No.: US 6,363,740 B1
(45) Date of Patent: Apr. 2, 2002

(54) CHILLED BEVERAGE DISPLAY CONTAINER

(76) Inventor: Gregory J. H. Hansen, 4 E. 64$^{th}$St., New York, NY (US) 10021

( * ) Notice: Subject to any disclaimer, the term of this patent is extended or adjusted under 35 U.S.C. 154(b) by 0 days.

(21) Appl. No.: 09/472,468

(22) Filed: Dec. 27, 1999

(51) Int. Cl.$^{7}$ ..... F25D 3/08

(52) U.S. Cl. ..... 62/457.5; 62/236; 62/246; 62/285; 62/332; 62/457.9; 62/457.2; 62/405

(58) Field of Search ..... 62/236, 246, 285, 62/332, 457.9, 457.5, 457.2, 405

(56) References Cited

U.S. PATENT DOCUMENTS

| | | | | | |
|---|---|---|---|---|---|
| 980,911 | A | * | 1/1911 | Bender | 62/246 |
| 1,002,333 | A | * | 9/1911 | Stollberg | 62/246 |
| 1,921,865 | A | * | 8/1933 | Curtis | 62/405 |
| 2,126,197 | A | * | 8/1938 | Lewis | 62/405 |
| 2,322,882 | A | * | 6/1943 | Raskin | 62/405 |
| 2,407,159 | A | * | 9/1946 | Jones | 62/405 |
| 2,437,417 | A | * | 3/1948 | Bookman | 62/405 |
| 2,511,851 | A | * | 6/1950 | Iwashita | 62/405 |
| 2,959,025 | A | * | 11/1960 | Morrison | 62/405 |
| 3,491,548 | A | * | 1/1970 | Christiansen | 62/246 |
| 4,367,633 | A | * | 1/1983 | Strathman | 62/236 |
| 4,773,230 | A | * | 9/1988 | Garrett | 62/237 |
| 4,856,579 | A | * | 8/1989 | Wolfe | 165/48.1 |
| 4,872,320 | A | * | 10/1989 | Ishizaka et al. | 62/255 |
| 5,271,241 | A | * | 12/1993 | Kim | 62/285 |
| 5,910,162 | A | * | 6/1999 | Harbour et al. | 62/246 |
| 6,067,810 | A | * | 5/2000 | Jennings et al. | 62/246 |

* cited by examiner

*Primary Examiner*—William Doerrler
*Assistant Examiner*—Mark Shulman
(74) *Attorney, Agent, or Firm*—Baker Botts LLP

(57) ABSTRACT

A chilled beverage display container has an outer casing that includes a base, a top rim member, a cover hinged to the top rim member so that the cover can be pivoted between a closed position and an open position, and a circular cylindrical peripheral wall member of a transparent material, the peripheral wall member being sealed to the base and to the top rim member so as to prevent substantially any flow of a gas into or out of the outer casing. A tub of a transparent material having an upper rim portion, a peripheral wall, and a bottom wall, is supported within the outer casing solely by attachment of the upper rim portion of the tub to the top rim member of the casing. The peripheral wall of the tub is spaced apart from the peripheral wall of the outer casing and the bottom wall of the tub is spaced apart from the base of the outer casing so as to form a dead air space between the tub and the outer casing. The upper rim portion of the tub is sealed to the top rim member of the casing so as to prevent substantially any flow of a gas into or out of the dead air space at an interface between the upper rim portion of the tube and the top rim member of the casing.

10 Claims, 2 Drawing Sheets

CHILLED BEVERAGE DISPLAY CONTAINER

BACKGROUND OF THE INVENTION

The present invention relates to a chilled beverage display container of the type frequently used to hold cans or bottles of beverages and to keep them cold for display and for sale for immediate consumption.

Beverages in cans or bottles are often held and kept chilled for display and sale in free-standing barrel-like display containers. The most common use for such containers is in convenience stores, where they are usually placed close to the check-out counters to stimulate impulse purchases by departing customers. Most such display containers are chilled by ice or frozen "blue-ice" packs, though some are available with refrigeration units.

It is quite important that beverage display containers of the type in question be well-insulated in order to hold ice for long periods of time, thus making the container economical to operate in terms of both the amount of ice needed and the costs of labor for adding ice and draining water—containers chilled with ice have drain hoses that are normally closed by a valve, which the clerk uses to drain water from the container periodically. Also, it is essential that condensation not occur on the outer surfaces of the container, lest condensate drip onto the floor, where it can lead to soiling of the floor by wetting the soiled shoes of customers who then track dirt and moisture wherever they walk. Accordingly, all presently available chilled beverage display containers have an outer casing, an inner tub supported in the casing with spacing between the casing and the tub, and an insulating material, such as foam or fiber, in the space between the casing and the tub.

Beverage display containers of the above-described type usually have a transparent, hinged lid, which allows a potential purchaser to observe the contents, at least when the container is nearly full of cans or bottles, without lifting the lid. As the container nears empty, an observer cannot readily view the contents. From a marketing point of view, the display container becomes less effective in enticing an observer to make an impulse purchase when he and she cannot easily see the product. Also, the store clerks cannot determine when the container needs to be replenished, when ice needs to be added, or when water needs to be drained.

BRIEF SUMMARY OF THE INVENTION

An object of the present invention is to improve the marketing effectiveness of chilled beverage display containers by making the product contained in the container significantly more visible. Another object is to enhance the serviceability—frequent refilling with beverages and ice and drainage of excess water—of chilled beverage display containers by clerks. It is also desired to retain the efficiency and efficacy of presently known chilled beverage display containers in terms of minimal use of ice (or other refrigeration) and avoidance of condensation on the outside walls.

The foregoing objects are attained, in accordance with the present invention, by a chilled beverage display container having an outer casing that includes a base, a top rim member, a cover hinged to the top rim member so that the cover can be pivoted between a closed position and an open position, and a circular cylindrical peripheral wall member of a transparent material, the peripheral wall member being sealed to the base and to the top rim member so as to prevent substantially any flow of a gas into or out of the outer casing. A tub of a transparent material having an upper rim portion, a peripheral wall, and a bottom wall, is supported within the outer casing solely by attachment of the upper rim portion of the tub to the top rim member of the casing. In that regard, the upper rim portion of the tub may be integral with the top rim member of the casing, as is known per se. The peripheral wall of the tub is spaced apart from the peripheral wall of the outer casing and the bottom wall of the tub is spaced apart from the base of the outer casing so as to form a dead air space between the tub and the outer casing. The upper rim portion of the tub is sealed to the top rim member of the casing so as to prevent substantially any flow of a gas into or out of the dead air space at an interface between the upper rim portion of the tub and the top rim member of the casing.

The transparent walls of the casing and tub of a beverage container according to the present invention considerably increases the visibility of the cans and bottles as compared with previously known containers with opaque walls, thus increasing the market appeal of the products for sale based on impulse buying. Large quantities of cans and bottles in the container can be viewed from a distance and from any aspect. The products can be readily observed even when the supply is somewhat depleted. Although beverage containers of the type of the present invention are often supplied to retail outlets by beverage makers for use exclusively with their products, many makers have a range of products, such as regular, diet, and the like. An observer can readily see the specific item he or she desires, which is not always the case when the product can only be seen through a transparent lid. The increased visibility to a potential purchaser is of considerable advantage, from a sales appeal point of view, when the container is used to display many brands of beverages, inasmuch as a potential purchaser can easily see the various brands and choose one of ones he or she favors.

The transparent walls also greatly improve the serviceability of the container. The outlets where containers of the type involved here are most often used usually rely on one or two check-out clerks for not only handling sales but for servicing the container and other point-of-sale displays. The increased visibility of the products in the container permits the clerks to see more readily, even from behind the check-out counter, when the supply of beverages is getting low, when ice needs to be added, and when water from melted ice needs to be drained. Better service of the container leads to greater customer appeal and thus increased sales.

A beverage container embodying the present invention retains the features of efficiency and efficacy of previously known beverage containers. Insulation is provided by the dead air contained in the space between the side and bottom walls of the casing and the tub. Also, the tub is supported solely at the top rim, so that a thermal conductive path through solid/material exists only at the rim, which is above the level of ice and beverage containers. Thus, the path for heat flow from the part of the tub that contains ice and beverage containers to the casing is relatively long, especially as the supply of ice and products in the container is depleted. The effectiveness of the dead air as an insulator ensures that condensate does not form on the outer surfaces of the casing. The lack of condensate not only prevents water from dripping on the floor but ensures that the transparency of the container is preserved. Under most ambient conditions, condensate does not form to any significant degree on the outer walls of the tub. In that regard, it is preferred that the tub be of a polymeric material (plastic). One characteristic of polymeric materials is that they have a relatively low coefficient of thermal conductivity. Accordingly, a relatively large temperature gradient exists between the inner and outer surfaces of the tub, thus tending to keep the outer surface of the tub warm enough (relative to the dew point of the air in the dead space) to prevent condensate from forming.

Advantageously, the tub may be a unitary moldment of a rigid transparent polymeric material. A unitary tub ensures against leakage and is easy to clean. The polymeric material has a low thermal conductivity, as mentioned above. The peripheral wall member of the casing may likewise be of a rigid transparent polymeric material and may be fabricated by bending a flat sheet into a tube having abutting edges forming a butt joint. The abutting edges are joined by splice plates or some other suitable mechanical splicing element. It is also possible to form an overlap joint at the meeting edges of the sheet and join the overlap by an adhesive or mechanical fasteners.

The base of the casing, in a preferred construction of the container, includes a bottom rim member, a casing bottom wall member joined to the bottom rim member, and a casing liner wall member joined to the bottom rim member and spaced apart from the casing bottom wall member. Either the casing bottom wall member or casing liner wall member of both are sealed to the bottom rim member so as to form a dead air space in the casing. The liner is optional but improves the appearance by concealing structures associated with the rim that form receptacles for the mounting posts of casters, which are conventionally provided for mobility of the container.

The top rim member (whether separate from or unitary with the top rim member of the casing) and bottom rim member of the casing, preferably, have flange portions forming grooves that receive upper and lower edge portions of the peripheral wall member. That feature of construction ensures that the peripheral wall holds its shape circumferentially and enhances the structural integrity of the casing.

DESCRIPTION OF THE DRAWINGS

For a more complete understanding of the present invention, and the advantages thereof, reference may be made to the following written description of exemplary embodiments, taken in conjunction with the accompanying drawings.

DESCRIPTIONS OF THE EMBODIMENTS

Figure 1:
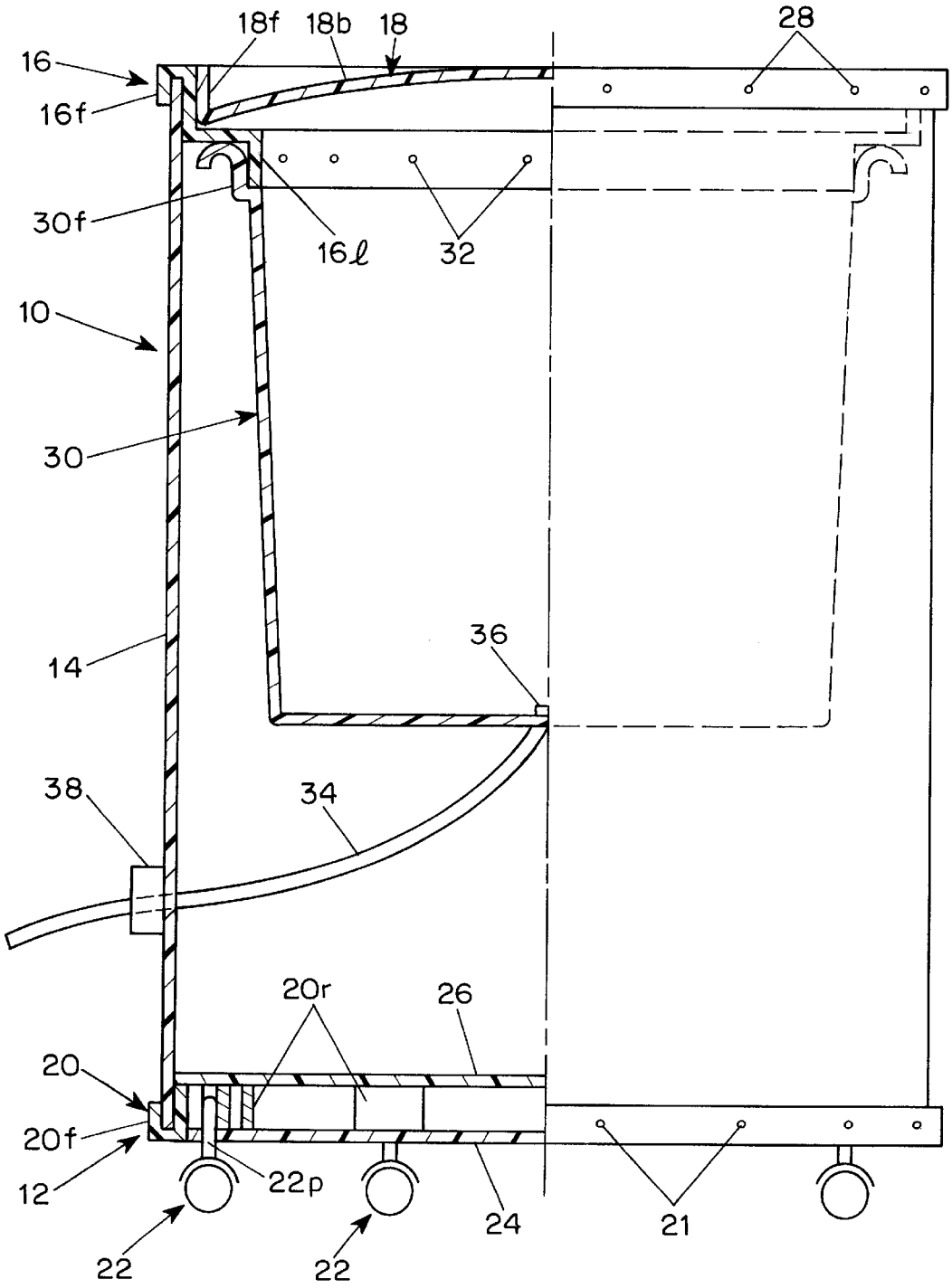
FIG. 1 is a half side-elevational/half cross-sectional view of a first embodiment.
Figure 2:
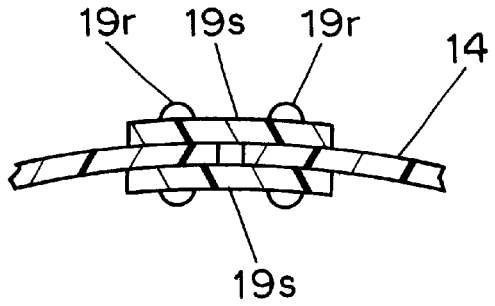
FIG. 2 is a detail top cross-sectional view, showing a splice at a butt joint between the ends of a sheet that forms the peripheral wall of a casing of the first embodiment.

The embodiment of FIG. 1 has a casing 10, which consists of a base assembly 12, a circular cylindrical peripheral wall member 14, a top rim member 16 and a cover 18. The cover 18, which has a dome-shaped body portion 18*b* and an upwardly extending peripheral flange portion 18*f* and is molded of a transparent polymeric material, is joined to the top rim member 16 by a hinge, not shown, so that it can be pivoted between a closed position (as shown) and an open position (not shown). A gripping rib (not shown) that projects from the upper surface of the body portion 18*b* enables a purchaser to lift the cover to fetch a can or bottle from the container.

The peripheral wall member 14 of the case is formed from a rectangular sheet of a polymeric material, which is bent into a tube. The ends of the tube form a butt joint (see FIG. 3) and are joined by inner and outer splice strips 19*s* and rivets 19*r*. As mentioned above, other forms of joint at the ends of the bent sheet can be used.

The base assembly 12 includes an annular bottom rim member 20. The bottom rim member, which is molded from a polymeric material, has an edge flange portion 20*f* of "U" shape in cross section so as to provide a groove that receives a lower edge portion of the peripheral wall member 14. The lower end portion of the peripheral wall member 14 is fastened to the bottom rim member 20, such as by rivets 21. Five caster post receptacle portions 20*r* that are unitary with the bottom rim member 20 and are located equidistant from each other circumferentially project radially inwardly from the edge flange portion 20*f*. Each receptacle portion 20*f* has a bottom wall, a tubular outer wall, and inner tubular socket, and four ribs located equidistant from each other circumferentially and connecting the socket to the outer wall. The construction of the receptacle portion is not shown in exact detail in the drawing, inasmuch as it is known per se. Each socket receives a liner (not shown) and the mounting post 22*p* of a caster 22.

The base assembly 12 also has a bottom wall member 24, which is a circular plate that is recessed slightly into the underside of the bottom rim member 20 and is suitably fastened to a circumferentially extending and inwardly projecting rib (not shown) on the bottom wall member. A circular bottom liner wall member 26 is attached to the upper edge of the bottom rim member. The liner member is optional and simply improves the appearance of the casing by concealing the caster post receptacle portions 20*r* and presenting a smooth bottom of the casing—note that the bottom assembly is visible through the transparent peripheral wall 14. The liner member can bear verbal and graphic material.

The top rim member 16 of the casing is molded of a polymeric material and has an outer flange portion 16*f* that forms a groove in which the upper edge portion of the peripheral wall 14 is received. Fasteners, such as rivets 28 secure the top rim member 16 to the upper edge portion of the peripheral wall member 14. An L-shaped flange portion 161 adjoins the outer flange portion 16*f* and forms a shelf for supporting the cover 18 and an attachment point for a tub 30. The tub 30 is supported in the casing 10 solely by attachment, such as by rivets 32, of an upper flange portion 30*f* of the tub to the dependent leg of the flange portion 161 of the upper rim member 16. The tub is a unitary moldment of a polymeric material. The flange portion 30*f* has an offset, which enables the inner surface of the upper end portion of the tub to lie flush with the inner surface of the mounting flange 161. As mentioned above, the top rim member and the rim of the tub may be unitary.

A flexible plastic drain hose 34 is attached to a fitting 36 installed in the bottom of the tub 30 and leads out through a pinch valve unit 38 installed in the peripheral wall member 38. A length of the hose 34 projects from the casing so that a bucket can be placed under the outlet end to collect water drained from the tub. A drain for the tub can also be made of rigid tubing.

The container relies on the maintenance of a dead air space between the peripheral wall member 14 and bottom assembly 12 of the casing 10 and the tub. To that end, suitable seals, such as gaskets, adhesive foam tapes, or some other sealing media (not shown, and optional) may be provided between the bottom rim member 20 and the lower end portion of the peripheral wall member 14, between the top rim member 16 and the peripheral wall member 14, between the bottom rim member 20 and one or both of the members 24 and 26, and between the rim of the tub 30 and the mounting flange 161 of the top rim member. Although it is not necessary for the dead air space to have a hermetic seal from the ambient environment, the seals between the casing and the tub should substantially prevent any air flow into and out of the dead air space, lest the efficiency of the dead air space as an insulator be reduced.

Figure 3:
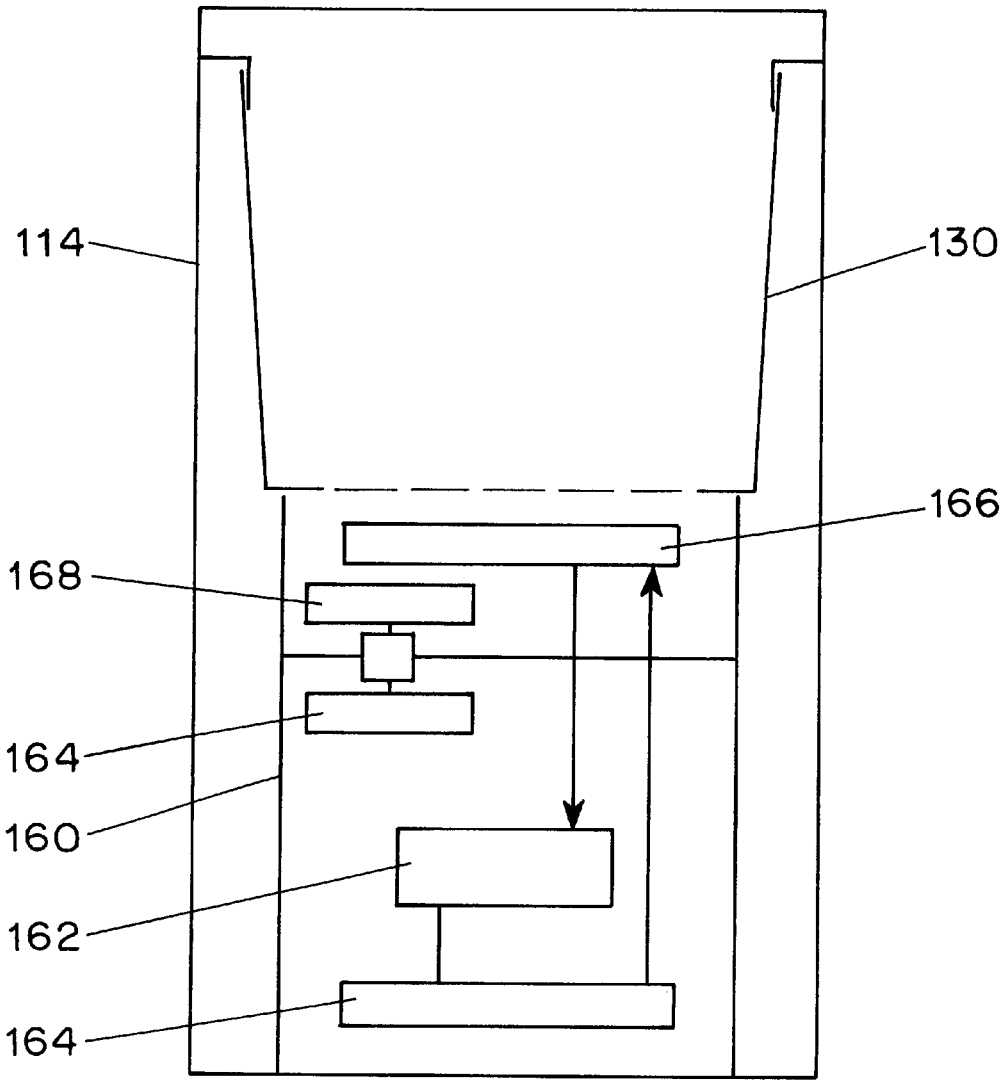
FIG. 3 is a schematic cross-sectional view of a second embodiment.

The second embodiment of a chilled beverage display container, shown schematically in FIG. 3, cools the beverage products in a tub 130 by cold air supplied to the tub by a small refrigeration unit, which is installed underneath the tub within a well-insulated housing 160 and is sealed to the tub by a suitable gasket. A compressor 162 delivers refrigerant to a condenser 164, from which heat is removed by air circulated through openings in the bottom wall of the casing 110 by a fan 164. After passing through an expansion valve (not shown), the refrigerant is conducted to an evaporator 166. A fan 168 circulates cold transferred from the evaporator through the tub through perforations in the bottom wall of the tub. The peripheral wall 114 of the casing and the tub are made of transparent polymeric materials, as in the first embodiment.

The lower portions of the outer peripheral walls 14 and 114 of both embodiments may have an opaque outer cover or inner liner, which may be imprinted with decorative or advertising material. As is known per se, the outer casings of chilled beverage containers are made sufficiently tall to locate the tub at a height that is convenient for observation by and access to purchasers. The lower portion of the casing can be regarded as merely a stand for the tub and need not be transparent. For economy of manufacture and for structural reasons, it is advantageous for the peripheral wall member of the casing to be unitary and, in accordance with the present invention, transparent, even though the lower portion may be made partly or fully opaque by applying a cover or liner.

What is claimed is:

1. A chilled beverage display container, comprising an outer casing having a base, a top that includes a top rim member, a cover hinged to the top rim member so that the cover can be pivoted between a closed position and an open position, and a circular cylindrical peripheral wall member of a transparent material, the peripheral wall member being sealed to the base and to the top rim member so as to prevent substantially any flow of a gas into or out of the outer casing; and a tub of a transparent material having an upper rim portion, a peripheral wall, and a bottom wall, the tub being supported within the outer casing solely by attachment of the upper rim portion of the tub to the top rim member of the casing, the peripheral wall of the tub being spaced apart from the peripheral wall of the casing and the bottom wall of the tub being spaced apart from the base of the outer casing so as to form a dead air space between the tub and the outer casing, and the upper rim portion of the tub being sealed to the upper rim portion of the casing so as to prevent substantially any flow of a gas into or out of the dead air space at an interface between the upper rim portion of the tub and the top rim member of the casing.

2. The chilled beverage display container according to claim 1, wherein the tub is a unitary moldment of a transparent polymeric material.

3. The chilled beverage display container according to claim 1, wherein the peripheral wall member of the casing is of a polymeric material.

4. The chilled beverage display container according to claim 3, wherein the peripheral wall member of the casing is a thermo-formed sheet having abutting edges forming a butt joint.

5. The chilled beverage display container according to claim 4, wherein the a butting edges are joined by splice plates.

6. The chilled beverage display container according to claim 1, wherein the base of the casing includes a bottom rim member, a casing bottom wall member joined to the bottom rim member, and a casing liner wall member joined to the bottom rim member and spaced apart from the casing bottom wall member, the casing bottom wall member and casing liner wall member being sealed to the bottom rim member so as to form a dead air space.

7. The chilled beverage display container according to claim 6, wherein the top rim member and bottom rim member have flange portions forming grooves that receive upper and lower edge portions of the peripheral wall member.

8. The chilled beverage display container according to claim 1, and further comprising a drain hose connected to an outlet in the bottom of the tub and leading through an opening in the peripheral wall member of the casing to an outlet end outside of the casing.

9. The chilled beverage display container according to claim 1, and further comprising a drain hose connected to an outlet in the bottom of the tub and leading through an opening in the peripheral wall member of the casing to an outlet end outside of the casing.

10. The chilled beverage display container according to claim 1, and further comprising a refrigeration unit for supplying cold air to the tub received under the tub in an insulated enclosure within the casing.

* * * * *